United States Patent [19]

Cantada

[11] 4,436,043

[45] Mar. 13, 1984

[54] GATE BRACKETING CUSHIONING SPRING ARRANGEMENT FOR A SEWING MACHINE

[75] Inventor: Edilberto Cantada, East Brunswick, N.J.

[73] Assignee: The Singer Company, Stamford, Conn.

[21] Appl. No.: 375,922

[22] Filed: May 7, 1982

[51] Int. Cl.[3] ..... D05B 3/02

[52] U.S. Cl. ..... 112/221; 112/158 R; 267/179

[58] Field of Search ..... 112/221, 158 R, 158 A, 112/78, 79 R, 163, 167, 237-239; 267/179, 166

[56] References Cited

U.S. PATENT DOCUMENTS

| | | | |
|---|---|---|---|
| 2,402,251 | 6/1946 | Johnson | 112/221 X |
| 3,266,449 | 8/1966 | Berg et al. . | |
| 3,387,579 | 6/1968 | Ciccotelli . | |
| 3,460,499 | 8/1969 | Gaines | 112/79 R |
| 3,727,568 | 4/1973 | Graham . | |
| 3,782,311 | 1/1974 | Adams et al. | 112/158 R |
| 3,799,090 | 3/1974 | Sheroff . | |
| 4,079,926 | 3/1978 | Nunes | 267/166 X |
| 4,312,284 | 1/1982 | Adams et al. | 112/158 R |
| 4,342,272 | 8/1982 | Transue et al. | 112/237 |

FOREIGN PATENT DOCUMENTS 5465248 10/1977 Japan .

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

Skip stitch mechanism for a sewing machine is provided with a coiled cushioning spring which mounts on the upper arm of a movable gate, and limits upward movement of a needle bar when disconnected from needle bar reciprocating mechanism to provide for a skipped stitch.

2 Claims, 6 Drawing Figures

GATE BRACKETING CUSHIONING SPRING ARRANGEMENT FOR A SEWING MACHINE

BACKGROUND OF THE INVENTION

1. Field of the Invention

The invention relates to skip stitch sewing machines which include needle bar latching and releasing mechanisms.

2. Description of the Prior Art

Skip stitch mechanisms, such as shown for example, in U.S. Pat. No. 3,782,311, of Kenneth D. Adams and Salvatore A. D'Orio for "Simplified Basting Stitch Mechanism" issued Jan. 1, 1974, and in U.S. Pat. No. 4,312,284 of Kenneth D. Adams for "Needle Bar Deflecting Arrangement for a Skip Stitch Sewing Machine" issued Jan. 26, 1982, include a normally engaged needle bar latch which is opened whenever the needle bar is jogged by a gate to a predetermined maximum lateral position on one side of a central needle bar position. The needle bar is thereby disconnected from actuating mechanism for imparting endwise reciprocatory motion thereto and a skipped stitch results. When the latch is opened to disconnect the needle from the actuating mechanism, the needle bar is drawn upward by an elevating spring into a limited position defined by the engagement of needle bar affixed structure with a fixed cantilevered cushioning spring. The cantilevered cushioning spring engaged the needle bar affixed structure at a location which is off-center with respect to the needle bar axis. As a consequence, the needle bar was loaded unsymmetrically, and undue noise was generated in the needle bar supporting bearings and in needle bar actuating mechanism. Further, the cantilevered spring had a high spring rate and this was responsible for considerable noise being generated whenever the needle bar returned to its uppermost position.

It is a prime object of the present invention to provide an improved arrangement for cushioning upward movement of an unlatched needle bar into an extreme position in a skip stitch sewing machine.

It is another object of the invention to provide an improved arrangement in a skip stitch sewing machine for applying a cushioning force to an upwardly moving unlatched needle bar released while in a maximum lateral jogged position from actuating mechanism.

It is still another object of the invention to provide skip stitch sewing machine mechanism with a needle bar cushioning spring which is inexpensive to produce and can be easily assembled in a machine.

It is also an object of the invention to provide a needle bar cushioning spring arrangement which is effective in sewing machines to minimize noise due to the operation of skip stitch mechanism.

Other objects and advantages of the invention will become apparent during a reading of the specification taken in connection with the accompanying drawings.

SUMMARY OF THE INVENTION

A coiled needle bar cushioning spring is provided in accordance with the invention for skip stitch mechanism in a sewing machine. The spring includes a pair of widely separated end coils which are spaced apart to bracket the arm of a movable gate that supports a needle bar for reciprocatory motion. One such coil is an extreme end coil which engages a needle bar bushing on an upper side of the arm of the gate and assists in holding the spring on the gate in a position wherein it is coaxial with the needle bar. The other coils of the spring extend around the needle bar under the gate arm to cushion upward movement of the needle bar when the needle bar is disconnected from actuating mechanism to provide for skip stitching.

DESCRIPTION OF THE PREFERRED EMBODIMENT

Figure 1:
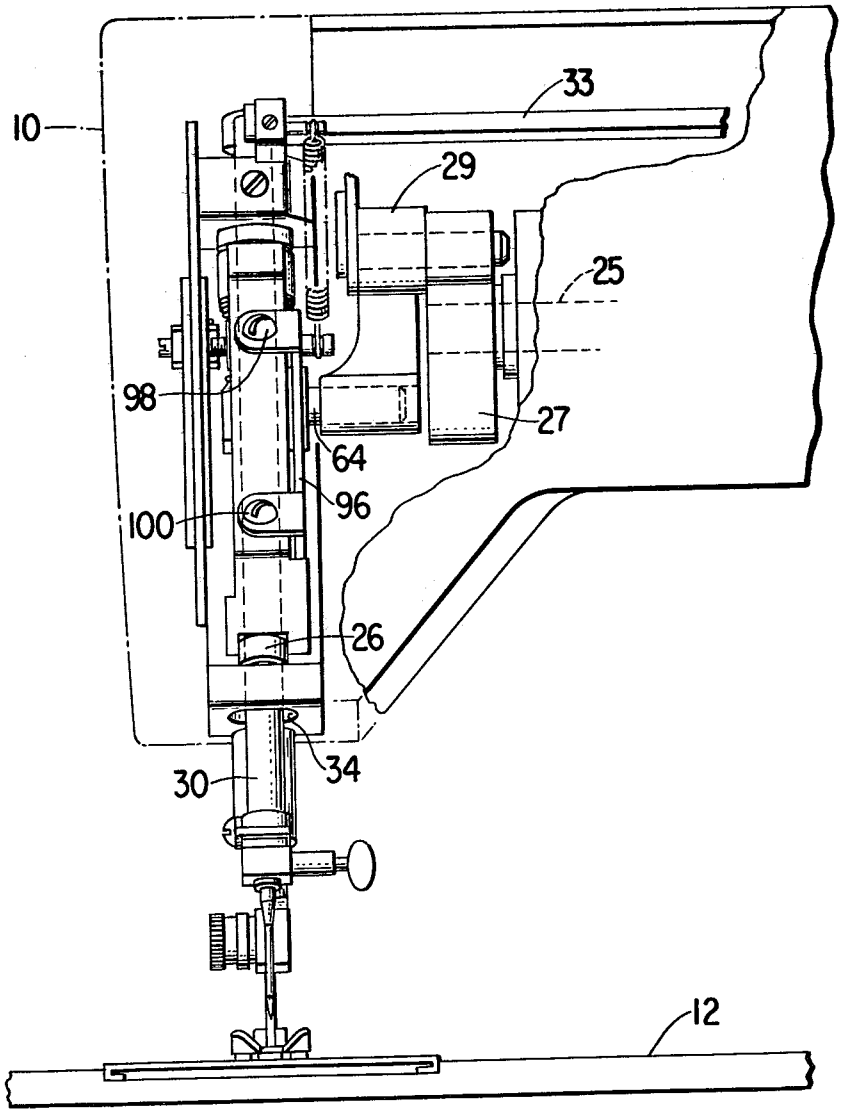
FIG. 1 is a front elevational view of the head end portion of a sewing machine incorporating the cushioning spring arrangement of the invention.
Figure 2:
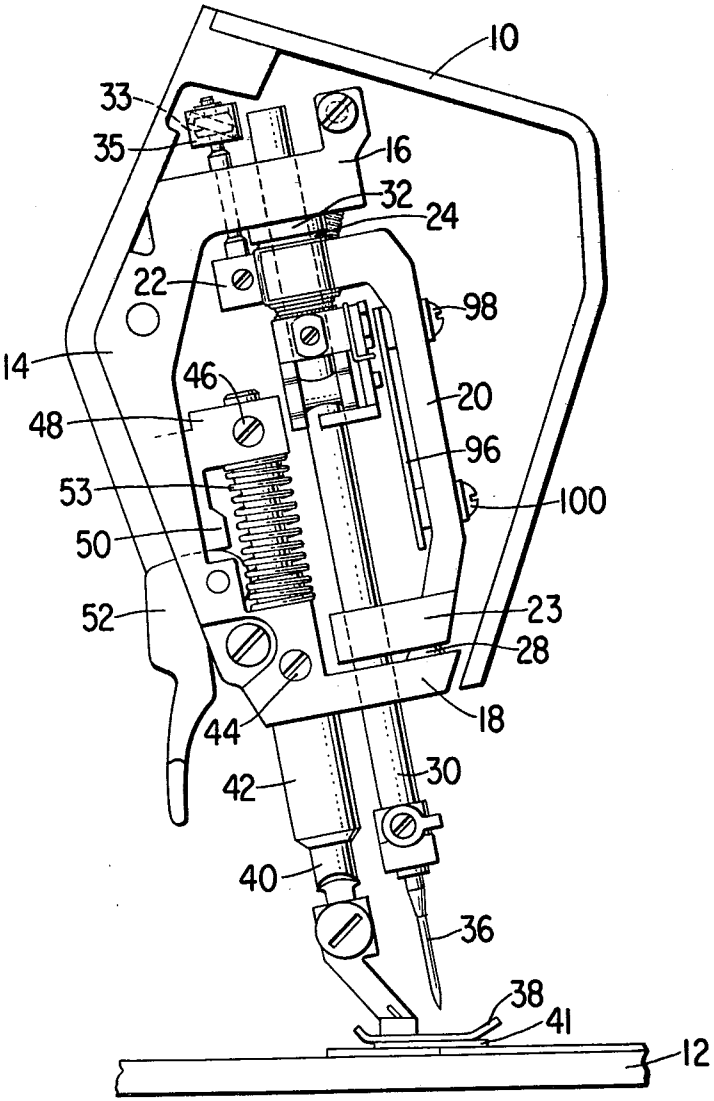
FIG. 2 is an end elevational view of the head end portion of the machine from which the end cover and an end face plate have been removed.
Figures 3, 4, 5, 6:
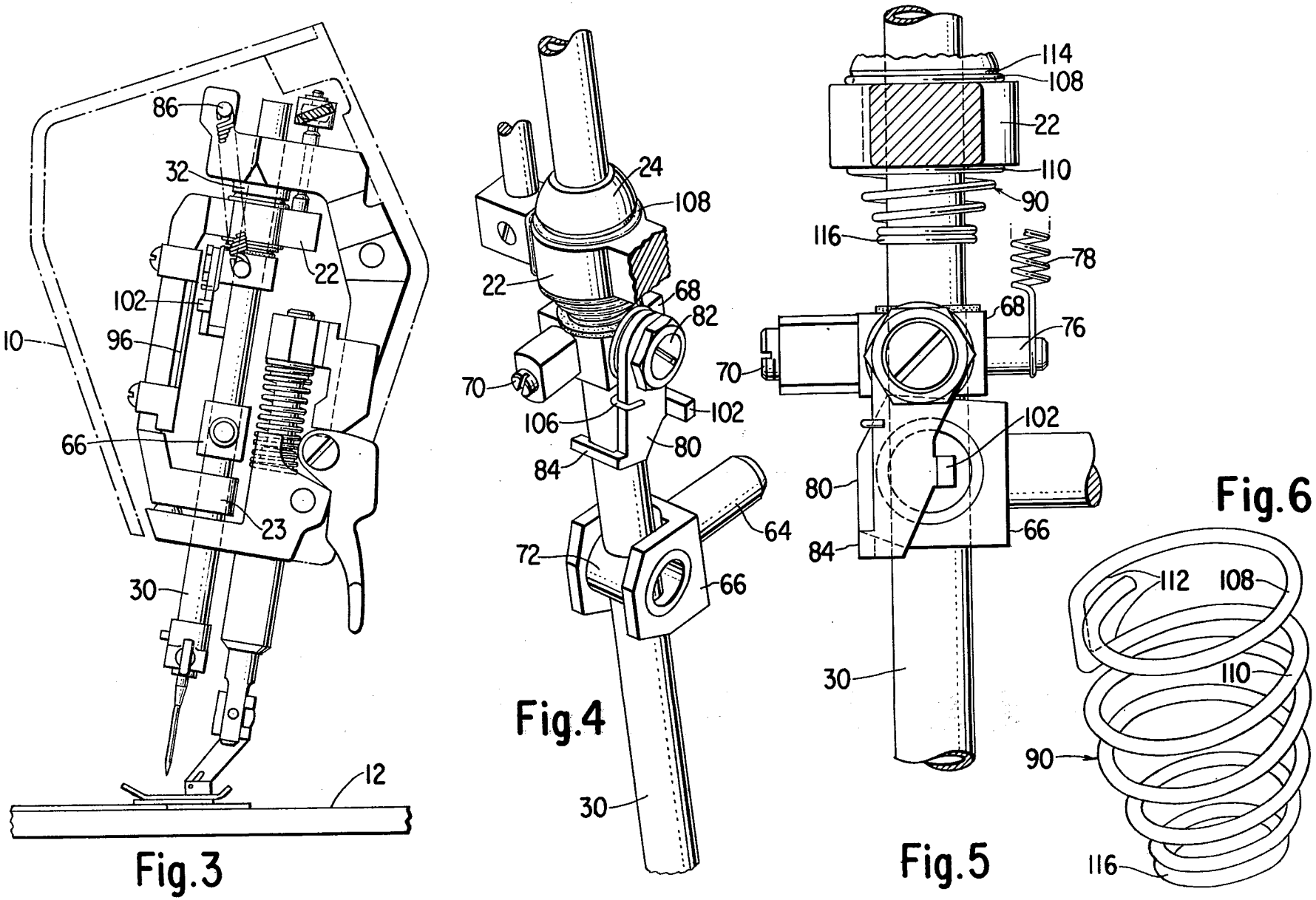
FIG. 3 is an elevational view of the head end portion of the machine as viewed from the interior of the machine in a direction opposite to that of FIG. 2.
FIG. 4 is a fragmentary perspective view showing a cushioning spring arranged according to the invention, and needle bar latch mechanism detached from needle reciprocating drive means.
FIG. 5 is a fragmentary front elevational view showing the cushioning spring, and the latch mechanism connected to the reciprocating drive means.
FIG. 6 is an enlarged perspective view of the cushioning spring.

Referring to the drawings, reference characters 10 and 12 designate the head end portion and a work supporting bed portion respectively of a skip stitch sewing machine. As shown, the head end portion includes a fixed support bracket 14 having an upper extending arm 16 and a lower extending arm 18 wherein a gate 20 is journalled. Gate 20 includes an upper rearwardly extending arm 22 and lower rearwardly extending arm 23. Inserted in the upper arm of the gate 20 is an upper bearing 24 having an outer spherical surface and a coaxial internal bearing surface. Inserted into the lower arm of the gate is a bearing 26 having both an internal bearing surface and spaced therefrom a socket. A spherical headed rivet 28 affixed to the lower arm 18 of the support bracket 14 has its spherical head protruding into the socket.

A needle bar 30 is supported for endwise reciprocation by a rotating arm shaft 25 acting through a crank 27 and link 29. As shown, the needle bar 30 is supported in the internal bearing surface of the upper bearing in the upper arm of the gate 20 and in the internal bearing surface of the lower bearing in the lower arm of the gate. A socket bearing 32, having an internal clearance hole for the needle bar 30, is mounted in a bore in the upper arm 16 of the support bracket 14 and provides the socket for the outer spherical surface of the upper bearing 24 mounted in the upper arm 22 of gate 20. The needle bar 30 extends through an elongated opening 34 in the lower arm 18 of support bracket 14 which provides lateral clearance for the needle bar. The gate and needle bar are laterally movable by a link 33 on a needle bar post 35 in opposite directions for zig-zag sewing and to a position beyond their zig-zagging range for skip stitching. Link 33 may be operable by cam means as in the manner indicated in U.S. Pat. No. 3,559,601 of The Singer Company issued Feb. 2, 1971, or by a servomotor as in the manner indicated in U.S. Pat. No. 3,984,745 of The Singer Company issued Oct. 5, 1976.

Attached to the lower end of the needle bar 30 is a needle 36 which cooperates with a loop taker (not shown) in the bed portion 12 of the machine. A presser foot 38, affixed to a presser bar 40, serves to urge work material into contact with a feed dog 41. The presser bar is journalled in a bearing 42 which is affixed in a bore in the support bracket 14 by a screw 44. The upper end of the presser bar 40 has affixed thereto by a screw 46, a presser bar guide block 48. Such guide block 48 has a tang portion 50 slidable in a slot in the support bracket 14 to prevent undesireable rotation of the presser foot 38. The tang portion 50 of the presser guide block 48 also coacts with a presser bar lifting lever 52, journalled on the support bracket 14, to raise the presser foot from contact with the work material in the usual manner. Pressure exerted by the foot 38 on work material is controlled by tensioned spring 53.

As shown, link 29 connects through a driving stud 64 with a drive link 66 which may be latched to or unlatched from a latch carrier block 68 that is affixed to the needle bar 30 by a screw 70. The drive link 66 includes a collar 72 freely slidable on the needle bar 30 when the drive link 66 is unlatched from the block 68. On the opposite side of block 68 from screw 70, a pin 76 protrudes sufficiently to catch the hook end of a spring 78. On the forwardly disposed face of the block 68, a latch 80 pivots on a shouldered screw 82. The latch 80 is fashioned with a rearwardly directed latch finger 84 to extend beneath and clasp the drive link 66 to the block 68 affixed to the needle bar. A second hook end of spring 78 is attached to a fixed member 86. The spring 78 serves to lift the latch carrier block 68 and needle bar 30 to an elevated position whenever the latch 80 is disengaged from link 66. The height to which the latch carrier and needle bar may be carried is limited by a cushioning spring 90 which is mounted on the upper arm 22 of gate 20.

Normally the drive link 66 is latched to block 68 and the needle bar is reciprocated by the associated driving means whether the needle bar is in a central straight stitching position (FIG. 1 position), or is oscillated for zig-zag stitching. However, gate 20 is provided with a latch release abutment member 96 as disclosed in the aforementioned U.S. Pat. No. 3,782,311 for disconnecting latch 80 and thereby the needle bar reciprocating drive from the needle bar whenever the needle bar 30 is moved by link 33 acting upon gate 20 into a skip stitch position for needle 36.

The latch release abutment member 96 which is adjustably attached to the gate 20 by screws 98 and 100 extends adjacent a forwardly extending ear 102 on latch 80. As described in the said U.S. Pat. No. 3,782,311, when the gate is moved (to the left as viewed in FIG. 1), beyond a maximum bight position for needle 36 to a skip stitch position, abutment member 96 is disposed to strike forwardly extending ear 102 on latch 80 moving to the right with the needle bar and uncouple the latch from the needle bar reciprocating drive thereby causing the needle bar to be drawn upwardly by spring 78 until block 68 on the needle bar impacts against the cushioning spring 90. When contact between the abutment member 96 and forwardly extending ear 102 of the latch 80 is eliminated by movement of the gate to the right, the latch is rotated by torsion spring 106. When drive link 66 reaches the latch 80 held in the relatching position by spring 78, connection is again made to the needle bar reciprocating drive to initiate reciprocation of the needle bar.

As shown, cushioning spring 90 is formed with widely spaced upper end coils 108 and 110. The coils 108 and 110 are connected by a U-shaped spring portion 112 which can be resiliently deformed to alter the spacing between said coils and so permit the spring to be clipped onto or removed from the gate arm 22. In the mounted position of spring 90 on the gate arm, extreme upper end coil 108 bears against top of arm 22 and engages a groove 114 in bearing 24. All of the other coils of the spring extend under gate arm 22 and taper from a maximum diameter at coil 110 in tight engagement with the underside of the arm to a minimum diameter at the extreme lower end 116 of the spring. The spring is held on the gate arm with its coils coaxial with respect to the needle bar 30, and the needle bar extends through the coils as shown. The spring therefor loads the needle bar centrally when engaged by block 68, and undue noise in the needle bar supporting bearings as well as in the needle bar actuating mechanism is prevented. Further, the number of coils and diameter of the wire forming the spring are selected to provide a spring rate effective to minimize the noise level.

It is to be understood that the presnt disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine, a needle bar, a movable gate with a bearing therein in which the needle bar is supported for endwise reciprocation, latching means carried on the needle bar, actuating means for imparting endwise reciprocatory motion to the needle bar through said latching means, means for unlatching the latching means from said actuating means, elevating spring means for raising the needle bar when unlatched from the actuating means, a fixed member on the needle bar, and a cushioning spring clipped with upper end gate bracketing coils onto the gate structure in a coaxial position with respect to the needle bar for engagement by said fixed member when the needle bar is raised by the elevating spring means, the said bearing being located in an arm on the gate for the needle bar, the bearing being encircled and gripped on an upper side of the arm by one of the coils of the cushioning spring, and the the other coils of the spring being located under the arm.

2. The combination of claim 1 wherein the coils under the arm decrease in diameter downwardly from the arm.

* * * * *